United States Patent [19]

Brems et al.

[11] Patent Number: 4,516,504

[45] Date of Patent: May 14, 1985

[54] CROSS-OVER TRACK STRUCTURE FOR WHEELED PALLETS

[75] Inventors: John H. Brems, Boca Raton, Fla.; John L. Vaphiadis, Troy, Mich.

[73] Assignee: Lamb Technicon Corp., Warren, Mich.

[21] Appl. No.: 481,344

[22] Filed: Apr. 1, 1983

[51] Int. Cl.[3] ..... E01B 7/10; E01B 7/28

[52] U.S. Cl. ..... 104/130; 104/132; 104/105; 246/454; 246/458; 246/468

[58] Field of Search ..... 104/130, 132, 96, 105; 246/454, 458, 465, 468, 457, 462, 463, 464, 470, 471, 472

[56] References Cited

U.S. PATENT DOCUMENTS

| | | | |
|---|---|---|---|
| 3,139,839 | 7/1964 | Ashworth | 104/130 |
| 3,408,950 | 11/1968 | Puhringer | 246/457 |
| 3,791,306 | 2/1974 | Wagner | 104/105 |
| 3,797,401 | 3/1974 | Alimanestianu | 104/130 |

*Primary Examiner*—Randolph Reese
*Assistant Examiner*—Dennis Rodgers
*Attorney, Agent, or Firm*—Barnes, Kisselle, Raisch, Choate, Whittemore & Hulbert

[57] ABSTRACT

A conveying and storage system for wheeled pallets has tracks each formed by a pair of generally parallel rails. The pallet has grooved wheels at one side for riding on the upper edge of one rail and a roller on the other side for riding on the upper edge of the other rail. At the intersection of the tracks, the two wheel engaging rails are interconnected by a frog on which the peripheries of the grooved wheels roll. Where a wheel engaging rail crosses a roller engaging rail, the roller engaging rail is interrupted and elevated pads are provided that are coplanar with the upper edges of the rails. The pads are arranged to support the rollers as they negotiate the gap in the roller engaging rail.

7 Claims, 10 Drawing Figures

CROSS-OVER TRACK STRUCTURE FOR WHEELED PALLETS

This invention relates to gravity conveyors and more particularly to conveyors of the type having tracks in the form of a pair of laterally spaced rails on which wheels of pallets are adapted to roll.

For some applications an ideal conveyor and storage system is one that utilizes wheel supported pallets that ride on tracks. In such systems, it is desirable to employ pallets that have two grooved or flanged wheels at one side that ride on one rail of the track and an unflanged wheel in the form of a straight cylindrical roller that rides on the other rail. The pallet is guided along the track by the flanges of the two grooved wheels and the unflanged wheel is relatively wide so that it will always ride on the upper edge of the other rail even though the spacing between the rails may vary. Three wheels should be employed on the pallets so that all wheels will be engaged with their respective rails.

The problem that arises in the design of a gravity conveyor system of this type results from the fact that as a practical necessity, one track has to cross another or branch off to form a spur. At such track intersections, the rail engaged by the unflanged wheel or roller must be interrupted to form a gap therein sufficiently wide to accommodate the grooved wheels that ride on the crossing rail. Therefore, a track arrangement of this type is practical only if means are provided for preventing the unflanged wheel from falling into this gap as it negotiates a pair of crossing rails.

The object of this invention is to provide a simple and inexpensive arrangement at the intersection of such tracks which permits the unflanged wheel to negotiate the intersection without dropping into the gap formed in the rail on which it is riding.

In the Drawings

Figure 1:
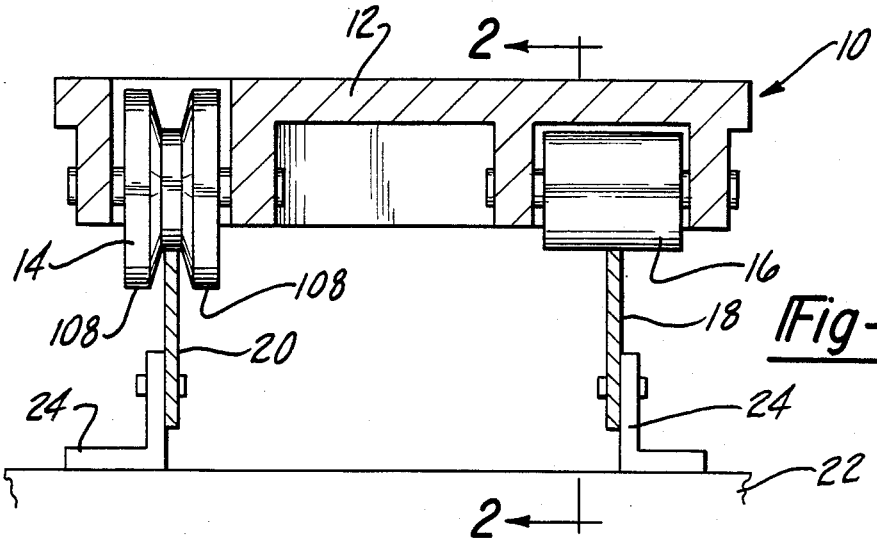
FIG. 1 is a sectional view of a wheeled pallet according to the present invention.
Figure 2:
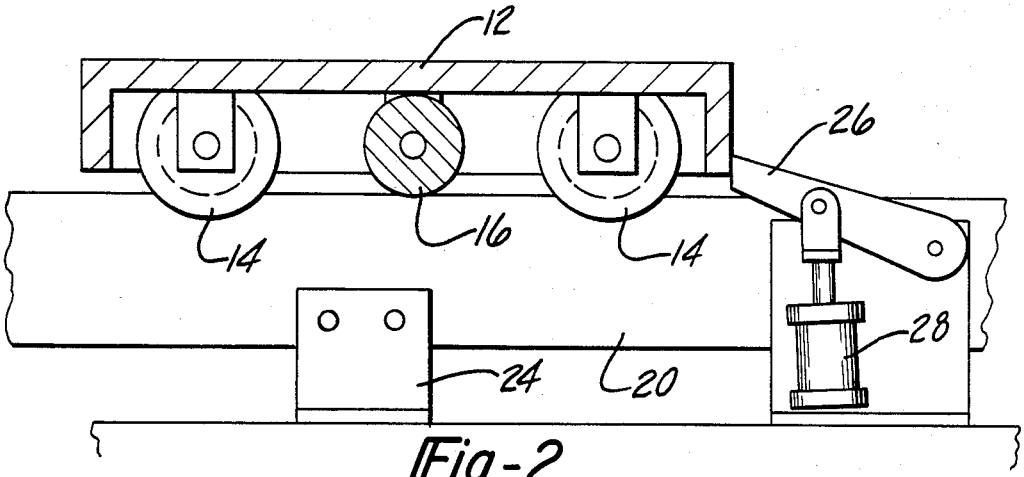
FIG. 2 is a sectional view along the line 2—2 in FIG. 1.

Referring to FIG. 1, the pallet 10 of the present invention has a body 12 at one side of which are journaled two grooved wheels 14 and at the opposite side thereof there is journaled an unflanged wheel 16 formed as a straight cylindrical roller. The diameter of roller 16 corresponds to the root diameter of the groove in wheels 14. Roller 16 is designed to ride on rail 18 and wheels 14 are designed to ride on rail 20. Rails 18, 20 are mounted on a support structure 22 by means of brackets 24. Three wheels are utilized on each pallet so that all the wheels will be in rolling contact with the rails, although the rails may not be horizontally parallel such as around a curve or a helical descent. As shown in FIG. 2, the tracks are inclined downwardly so that the pallets will be conveyed by gravity. At one or more locations on each track defined by rails 18, 20 there is provided a latch 26 for preventing the pallets from advancing along the track. Latch 26 engages the front end of the pallet and is adapted to be retracted to disengage the pallet by the actuation of a cylinder 28.

Figure 3:
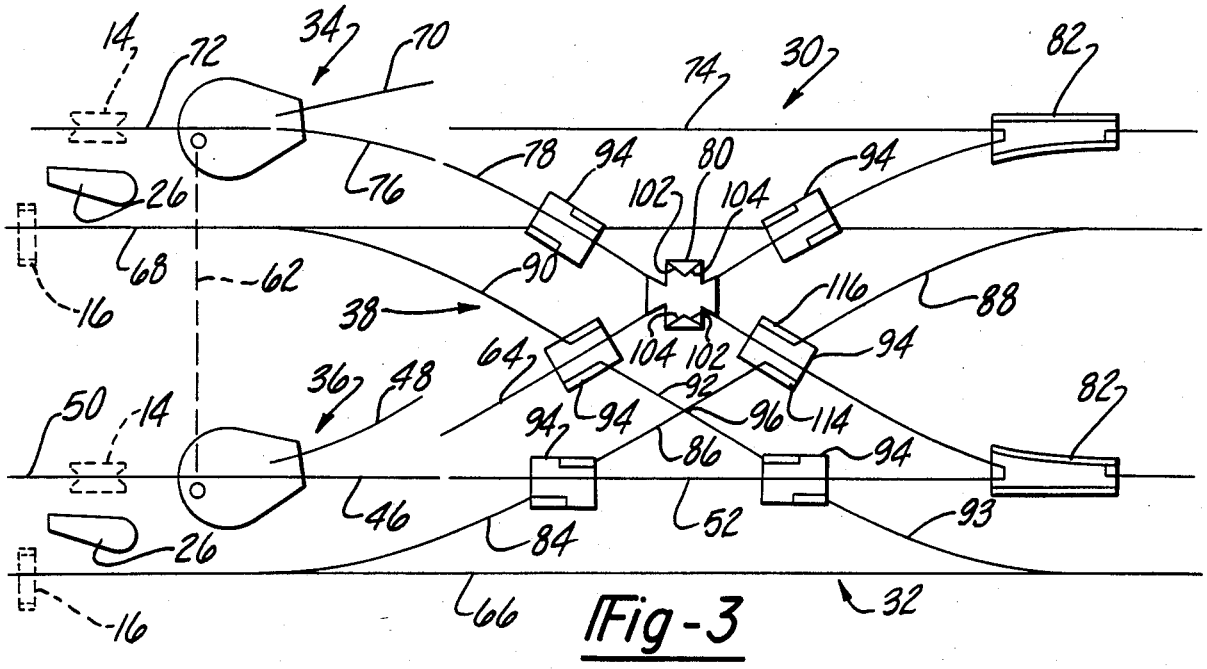
FIG. 3 is a diagrammatic plan view of a typical track switch and cross-over arrangement.

A typical track arrangement is shown in FIG. 3 for switching pallets from one track onto another. In this arrangement two main tracks 30, 32 as well as switches and cross-over track are illustrated. The two main tracks 30, 32 are intended for conveying pallets downwardly in a straight path when the latches 26 are released. The two switches are designated 34, 36 and the cross-over track is designated 38. In the positions of switches 34, 36 shown in FIG. 3, pallets traveling forwardly on track 30 would be switched over cross-over track 38 onto main track 32 and pallets traveling forwardly on track 32 would travel on a straight path past cross-over track 38.

Figure 4:
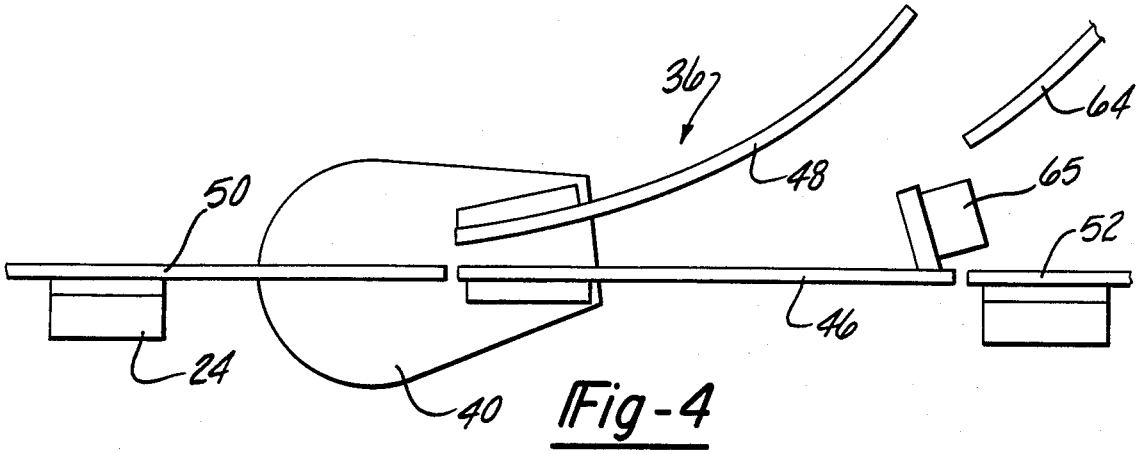
FIG. 4 is a plan view of the left hand switch shown in FIG. 3.
Figure 5:
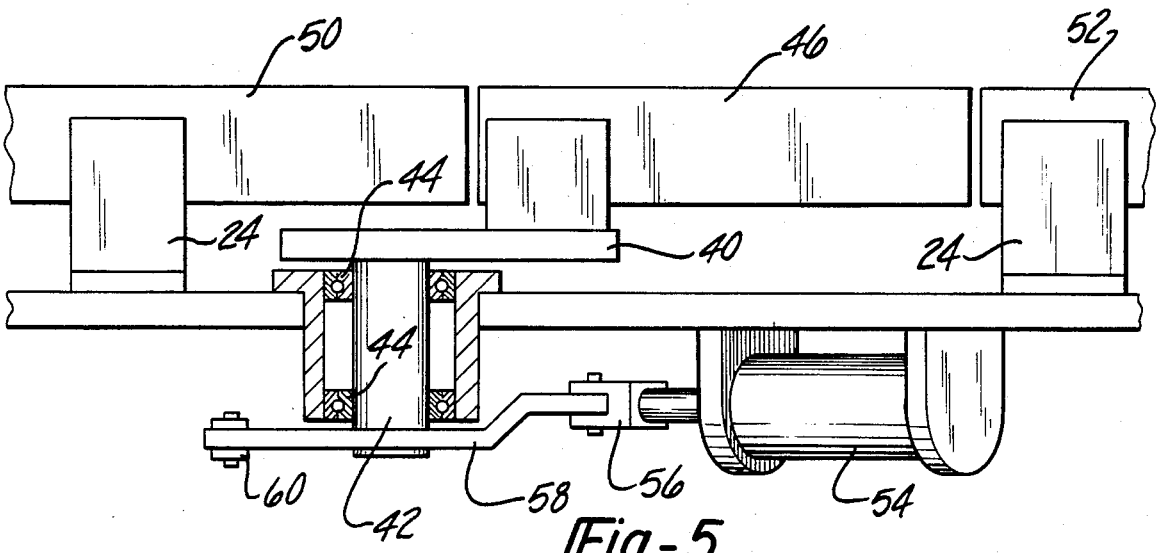
FIG. 5 is a side view of the switch shown in FIG. 4.

Switch 36 is shown in greater detail in FIGS. 4 and 5. The switch comprises a lever 40 having a shaft 42 journaled for rotation about a vertical axis on the support structure 22 by means of bearings 44. A straight rail section 46 and a curved rail section 48 are fixedly mounted on lever 40. In the position of the switch shown in FIG. 4, the straight rail section 46 is aligned with and interconnects the straight rail sections 50, 52 of main track 32. Switch 36 is adapted to be actuated by a cylinder 54, the rod of which is connected by a clevis 56 to one end of a lever 58 fixedly connected to the lower end of shaft 42. Another clevis 60 at the other end of lever 58 is connected to the rail supporting lever 40 of switch 34 by means of a link 62 (FIG. 3). When cylinder 54 is actuated from the position shown in FIGS. 4 and 5, lever 40 is pivoted clockwise so as to rotate the curved rail section 48 so that it is in alignment with and interconnects the straight rail 50 with the wheel engaging rail 64 of cross-over track section 38. Rotation of levers 40 in opposite directions is limited by rail engaging stops 65. The roller engaging rail of main track 32 is designated 66 in FIG. 3. The roller engaging rail of main track 30 is designated 68. Like switch 36, switch 34 has a straight rail section 70 adapted to align with and interconnect the straight wheel engaging rail sections 72, 74 of main track 30 and a curved rail section 76 which in the position of the switch shown in FIG. 3, aligns with and interconnects rail section 72 with rail section 78 of cross-over track 38.

Figure 8:
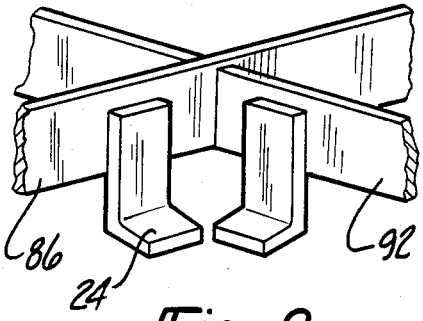
FIG. 8 is a perspective view of the structure at the intersection of two roller engaging rails.

The two rail sections 64, 78 of the cross-over track 38 intersect at frog 80. Downstream of frog 80, rail section 64 merges with rail 74 of main track 30 at a rail merging member 82. In a like manner downstream of frog 80, rail 78 merges with rail 52 of main track 32 by means of a similar rail merging member 82. The cross-over track 38 includes a first roller engaging rail consisting of three rail sections 84, 86, 88. Rail section 84 merges with rail 66 of main track 32, rail section 68 merges with rail 88 of main track 30 and rail section 86 extends between rail sections 84 and 88. The second roller engaging rail of cross-over 38 track comprises three rail sections 90, 92, 93. In the cross-over track 38, it will be observed that at the intersections of the wheel engaging rails with the roller engaging rails, a cross-over pad structure 94 is provided. In an arrangement such as shown in FIG. 3, six of such pad structures 94 are required. Since rails 86 and 92 are both roller engaging rails, they are simply connected together where they intersect as at 96 in the manner illustrated in FIG. 8.

Figure 9:
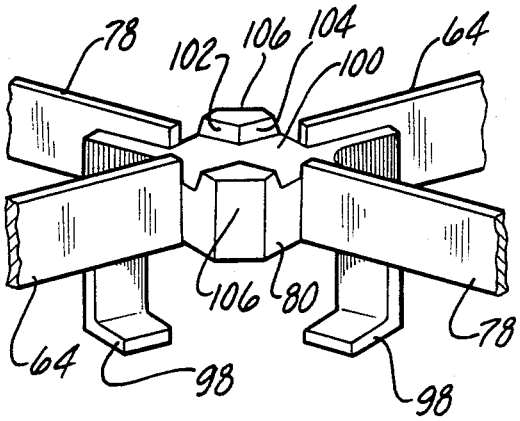
FIG. 9 is a perspective view of the frog at the intersection of two wheel engaging rails.

The construction of frog 80 is best illustrated in FIG. 9. At the intersection of rails 64, 78, the rails are terminated and interconnected by frog 80. Frog 80 is mounted on the support structure by brackets 98. Frog 80 comprises a block having two intersecting guideways recessed into the upper face thereof. The guideways are aligned with the crossing rails 64, 78. The bottom of both guideways is defined by the face 100 and the sides are defined by side walls 102, 104 on the inner faces of two upstanding generally triangular bosses 106 on the body of the frog. The face 100 of the frog is spaced below the upper edges of rails 78, 64, a distance corresponding to the depth of the groove of wheels 14. The opposed and staggered side walls 104 form a guideway for wheels 14 riding on rail 64, and the opposite and staggered side walls 102 form a guideway for the wheels 14 riding on rail 78. The width of these guideways corresponds generally to the width of the wheels 14. Thus, as a wheel 14 negotiates the intersection between rails 78, 64, the flange surfaces 108 of the wheels ride onto face 100 and the wheel is guided laterally by the side walls of the guideways. The height of the sidewalls 102, 104 is dimensioned in relation to the diameter of wheels 14 such that when a wheel 14 rides off one end of the intersecting rails, it is immediately engaged by the opposing side walls of the guideway in which it is rolling so that the wheel is guided laterally at all times at it crosses over the frog.

Figure 6:
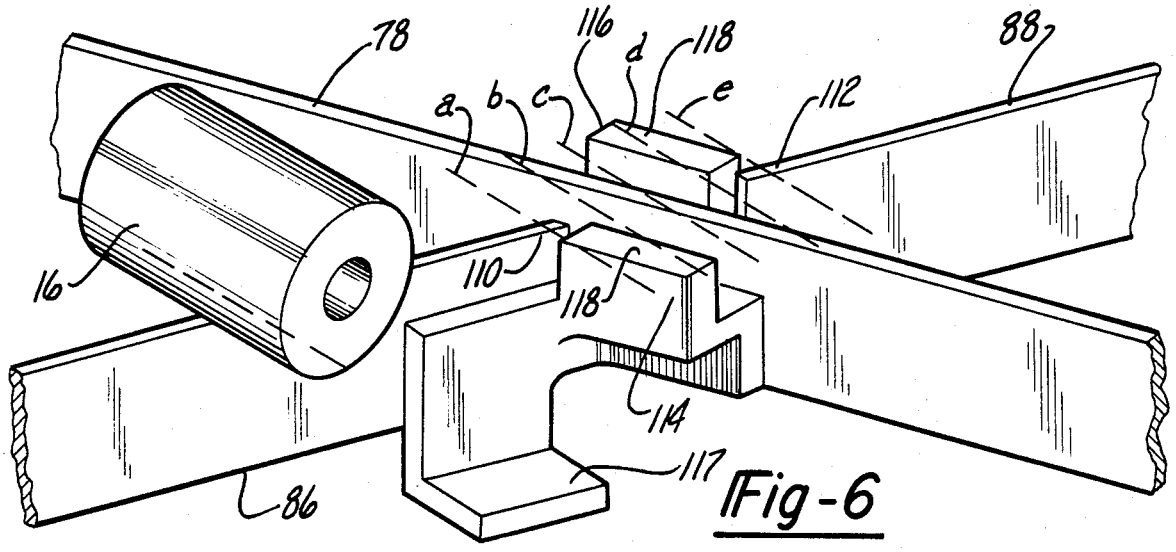
FIG. 6 is a perspective view of the cross-over pad structure at the intersection of a wheel engaging rail and a roller engaging rail.

Each of the cross-over pad members 94 are of the same construction. The pad member at the intersection of the wheel engaging rail 78 with the roller engaging rail sections 86, 88 is shown in greater detail in FIG. 6. To accommodate the wheel riding on rail 78, the opposed ends 110, 112 of rails 86 and 88 respectively, are spaced apart as shown. The length of the gap between the rail ends 110, 112 corresponds generally to the thickness of the wheels 14. The structure comprises a pair of pads 114, 116 which are disposed on opposite sides of rail 78 in parallel relation with the rail. The pads are formed at the upper ends of brackets 117 on which the adjacent portions of the rails are supported as shown in FIG. 6. The pads are spaced apart a distance corresponding generally to the thickness of wheels 14. The upper faces 118 of the pads are coplanar with the upper edges of the adjacent rails. Pad 114 extends downstream from the end 110 of rail 86 and pad 116 extends upstream from the end 112 of rail 88. The pads overlap one another in the direction of rail 78. The minimum length of the pads is related to the width of the unflanged wheels 16, that is, the axial length of the rollers. To prevent the cylindrical wheel from falling into the gap between the rail ends 110, 112, the pads have to be arranged such that the rollers are supported horizontally in the same plane at all times as they negotiate the gaps. The progressive advance of a roller over the gap between ends 110, 112 is designated by the broken lines a, b, c, d and e. At the position a, the roller 16 is riding off the rail end 110 and onto the top face 118 of pad 114. At position b, the roller is riding on the top face of pad 114 and also on the upper edge of rail 78. At position c, roller 16 is riding solely on the upper edge of rail 78. Before the roller rides off the upper edge of rail 78, it rides onto the upper face of pad 116 as shown at d and before it rides off the upper face of pad 116, it rides onto the upper edge of end 112 of rail 88 as shown at e. Thus, the unflanged wheel negotiates the gap between rails 86, 88 without the slightest interruption of its flat path of travel.

Figure 7:
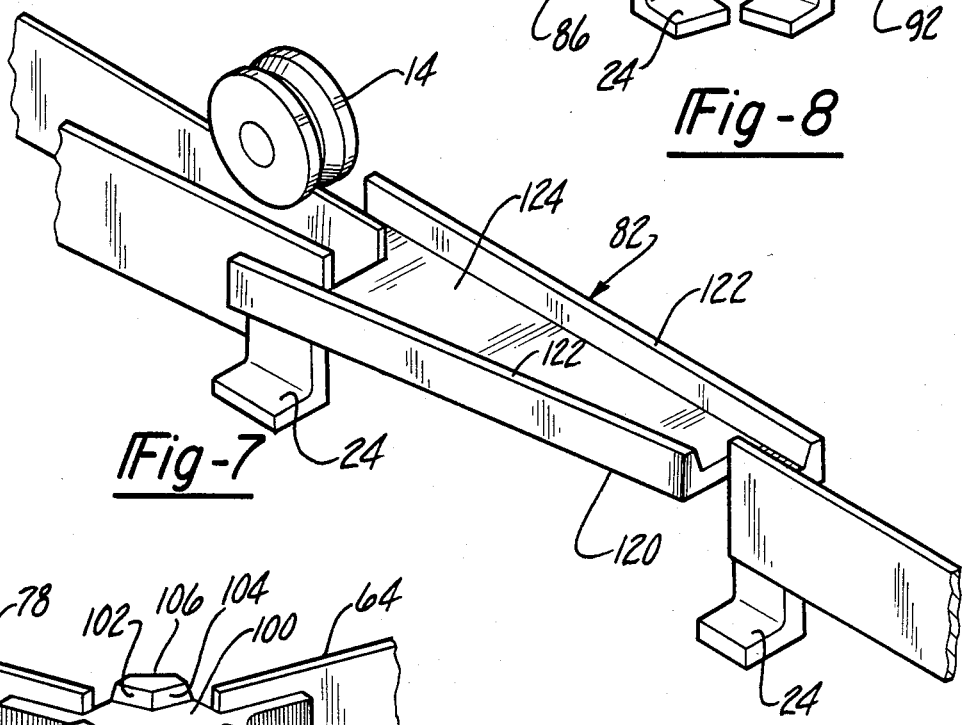
FIG. 7 is a perspective view of the structure at merging two wheel engaging rails.
Figure 10:
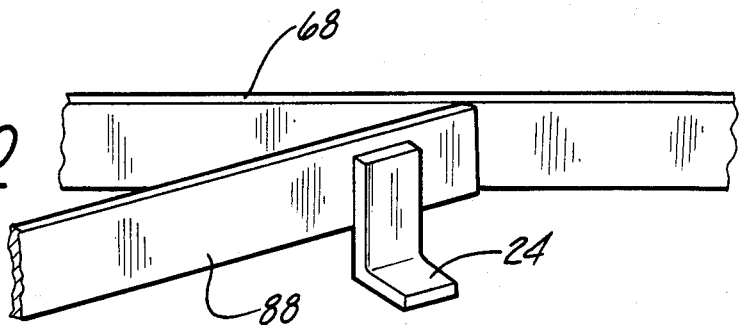
FIG. 10 is a perspective view of the structure at two merging roller engaging rails.

One of the rail merging members 82 is illustrated in FIG. 7. Each member 82 simply comprises a trough 120 having side walls 122 and a bottom wall 124 which is spaced below the upper edges of the adjacent rails a distance corresponding generally to the depth of the groove in the wheels 14. Side walls 122 converge as shown in FIGS. 3 and 7 such that as a wheel on the pallet rides off the end of either rail, it is guided laterally by the converging side walls 122. Where the roller engaging rails of the cross-over track 38 merge with the roller engaging rails of the main tracks 30, 32 the arrangement is very simple. One such merger is shown in FIG. 10, wherein it is illustrated that the end of the rail section 88 of the cross-over structure 38 simply extends to and terminates at rail 68.

We claim:

1. A gravity conveyor system for pallets of the type having a pair of downwardly inclined tracks which cross one another at an intersection, each crossing track comprising a pair of generally parallel laterally-spaced upright rails, the upper edges of the rails being generally coplanar adjacent said intersection, characterized in that each pallet is provided at one side thereof with a pair of peripherally grooved wheels adapted to ride on the upper edge on one of said rails of each track to guide the pallet along the track and with a straight cylindrical roller on its opposite side adapted to ride on the upper edge of the other rail in each track, the intersecting wheel engaging rails of the two tracks being interconnected by a frog, each wheel engaging rail being interrupted at said frog, said frog having a pair of intersecting guideways interconnecting the adjacent ends of the interrupted rail, each guideway having a bottom wall and a pair of side walls, the bottom walls of the guideways being coplanar, the side walls of each guideway being spaced apart transversely to accommodate the passage of the wheels therebetween, said bottom walls lying in a plane generally parallel to the plane of the upper edges of the portions of the rails adjacent the frog and being spaced below said upper edges a distance corresponding to the depth of the groove in said wheels, the intersections between the wheel engaging and the roller engaging rails of the two tracks being interconnected by a cross-over member, said wheel engaging rail having a section extending through said cross-over member, a pair of coplanar pads spaced laterally from said rail section on opposite sides thereof to permit a grooved wheel on said wheel engaging rail to roll therebetween, the roller engaging rail at the cross-over member being interrupted between said pads to form a gap defined by two spaced apart rail ends, said pads extending transversely of the spaced ends of the interrupted roller engaging rail, said pads being generally coplanar with the upper edges of said rail section and the spaced ends of the interrupted roller engaging rail, said pads having a length relative to the length of the roller and the included angle between the crossing rails such that when a roller on one of the pallets rolls off one of the spaced apart ends of the interrupted roller engaging rail and onto the other end thereof, the pads and said section of the wheel engaging rail provide a continuous support surface for the roller which prevents the roller from dropping into said gap.

2. The combination called for in claim 1 wherein the two pads extend lengthwise of said rail section and are disposed relative to said rail section and said rail ends such that when a roller traverses the interrupted portion of the roller engaging rail, it rides onto one of said pads before it rides off the adjacent end of the roller engaging rail, it then rides onto said section of the wheel engaging rail before it rides off the last mentioned pad, it then rides onto the other pad before it rides off said rail section and then rides onto the other end of the interrupted roller engaging rail before it rides off the last mentioned pad.

3. The combination called for in claim 2 wherein said pads have opposed inner upright faces that extend generally parallel to the wheel engaging rail therebetween.

4. The combination called for in claim 3 wherein one pad extends from the upstream end of the interrupted roller engaging rail in a direction downstream relative to the wheel engaging rail and the other pad extends from the downstream end of the roller engaging rail in a direction upstream relative to the wheel engaging rail.

5. The combination set forth in claim 4 wherein said pads overlap one another in a direction lengthwise of the wheel engaging rail.

6. The combination called for in claim 1 wherein the side walls of each guideway are staggered lengthwise of the guideway to accommodate the passage of a wheel in one guideway between the adjacent ends of the side walls of the other guideway.

7. The combination called for in claim 1 wherein the height of the side walls is related to the diameter and width of the wheels such that as a wheel rolls through either guideway it is engaged laterally by both side walls of the guideway as it rolls off one end of the rail and as it rolls onto the other end of the rail so that the wheel is always constrained laterally by either the rail or the side walls of the guideway.

* * * * *